US006224518B1

(12) United States Patent
Weiss et al.

(10) Patent No.: US 6,224,518 B1
(45) Date of Patent: May 1, 2001

(54) BENCH PRESS SHOULDER PROTECTION DEVICE AND METHOD THEREFOR

(76) Inventors: Jeffrey Weiss, 409 E. Keim, Phoenix, AZ (US) 85012; Doug Rich, 7402 E. Moreland St., Scottsdale, AZ (US) 85257

( * ) Notice: Subject to any disclaimer, the term of this patent is extended or adjusted under 35 U.S.C. 154(b) by 0 days.

(21) Appl. No.: 09/413,173

(22) Filed: Oct. 7, 1999

(51) Int. Cl.[7] ..... A63B 21/078
(52) U.S. Cl. ..... 482/93; 482/104; 482/106
(58) Field of Search ..... 482/93, 104–108

(56) References Cited

U.S. PATENT DOCUMENTS 4,867,444 * 9/1989 Castillo ..... 482/106
5,897,468 * 4/1999 Lumpkins ..... 482/106

OTHER PUBLICATIONS

Bodybuilder's Discount Outlet *Summer 1995 Catalog*p. 31 Bar Pad.*

* cited by examiner

*Primary Examiner*—John Mulcahy
(74) *Attorney, Agent, or Firm*—Jeffrey Weiss; Harry M. Weiss; Weiss & Moy, P.C.

(57) ABSTRACT

A shoulder protection device for use with a barbell, during the performance of a bench-press-type exercise. The device consists of a cylindrical pad adapted to be coupled to the barbell at a point substantially over the chest of a user, and having sufficient thickness to reduce the downward travel of the barbell during the performance of a bench-press movement. Such reduction, preferably, should be to the point where the upper arms descend to the horizontal plane defined by the back of the user, but do not break that plane.

8 Claims, 1 Drawing Sheet

BENCH PRESS SHOULDER PROTECTION DEVICE AND METHOD THEREFOR

FIELD OF THE INVENTION

This invention relates generally to exercise devices and methods therefor and, more specifically, to a device and a method for protecting the shoulder muscles of a person performing a bench-press-type exercise.

BACKGROUND OF THE INVENTION

The bench press is one of the most popular free weight exercises. While there are flat bench, incline bench, and decline bench versions, the flat bench version is the one most commonly practiced. Generally, to perform a flat bench press, a person lies in a supine position on a bench that is parallel to the ground, grasps a barbell that is positioned on a rack above the person's head, lifts the barbell to a position that is over the person's chest with the person's arms essentially fully extended, lowers the barbell until it touches the person's chest, and then lifts the barbell to a fully extended position. At the point in this motion when the barbell touches the chest, it is generally the case that at least a portion of the upper arms of the person will break the horizontal plane formed by the back of the user, and indeed will travel below the surface of the bench.

The bench press helps develop a person's pectoral muscles and, to some extent, the front deltoid and triceps muscles. However, as the upper arms break the horizontal plane defined by the back of the user, the head of the humerus moves forward within the glenoid cavity. This creates a pull against the posterior deltoid, infraspinatus and teres minor muscles, which are relatively weaker and smaller than the pectoral muscles. Where too much pull is created, the humeral head will push with sufficient force to stretch out the relatively weak anterior capsule and impinge the supraspinatus against the coracoacromial ligament and the acromion. Over time, these shoulder muscles and ligaments can become strained or torn.

Thus, a need existed for a device and method for allowing a person to perform a free weight, bench-press-type exercise with an ordinary barbell; to realize at least a substantial portion of the benefit to the pectoral muscles from bench press exercises; and to protect to a significant degree the shoulder muscles, including the deltoid and subscapuralis.

SUMMARY OF THE INVENTION

An object of the present invention is to provide a shoulder protection device for use with an ordinary barbell.

A further object of the present invention is to provide a shoulder protection device that allows a person to perform a bench press-type movement with substantial benefit to the pectoral muscles and protection for the shoulder muscles, including the deltoid and subscapularis.

BRIEF DESCRIPTION OF THE PREFERRED EMBODIMENTS

In accordance with one embodiment of the present invention, a shoulder protection device is disclosed. The shoulder protection device comprises, in combination: a pad adapted to be coupled to a barbell substantially at a location where the barbell contacts a person's chest during a bench-press-type exercise; wherein the pad projects outwardly from the barbell so as to reduce a distance the barbell can travel toward the chest during the bench-press-type exercise; a securing member adapted to secure the pad to the barbell during the bench-press-type exercise.

In accordance with another embodiment of the present invention, a method for providing a shoulder protection device is disclosed. The method comprising the steps of: providing a pad adapted to be coupled to a barbell substantially at a location where the barbell contacts a person's chest during a bench-press-type exercise; wherein the pad projects outwardly from the barbell so as to reduce a distance the barbell can travel toward the chest during the bench-press-type exercise; and providing a securing member adapted to secure the pad to the barbell during the bench-press-type exercise.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
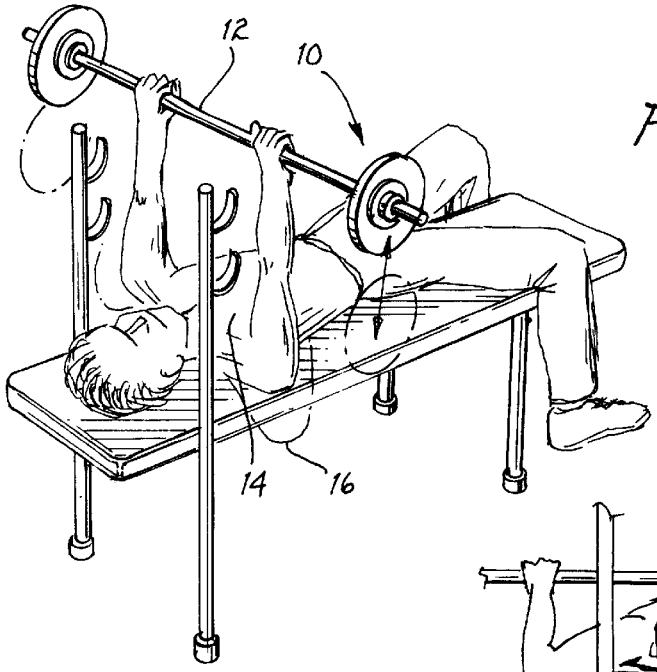
FIG. 1 is a perspective view of a person performing a bench-press-exercise with an ordinary barbell, without the shoulder protection device of the present invention, showing the path of the upper arm in phantom lines during the lowering of the barbell.
Figure 2:
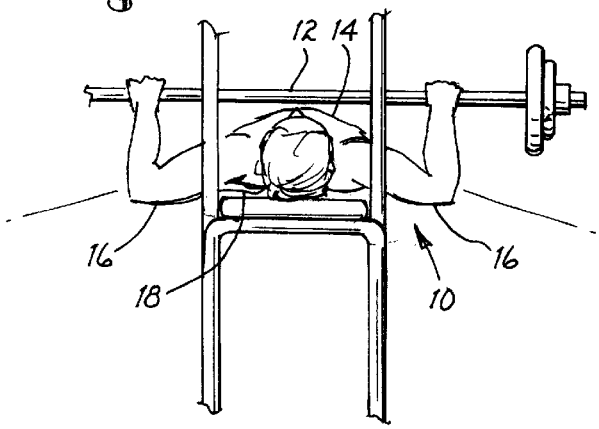
FIG. 2 is a rear view of a person performing a bench-press-exercise with an ordinary barbell, without the shoulder protection device of the present invention, showing the path of the upper arm in phantom lines during the lowering of the barbell.

Referring first to FIGS. 1–2, the prior art is illustrated. Here, a person 10 grasps a barbell 12 and positions it above the chest 14 as shown in FIG. 1. The barbell 12 is lowered until it contacts the chest 14 as shown in FIG. 2. As shown in FIG. 2 and in phantom in FIG. 1, when the barbell 12 is in this position, a portion of the upper arms 16 breaks the horizontal plane defined by the back 18, and point at an angle (as illustrated by the arrows in FIG. 2) toward the ground (not shown) below the person 10.

Figure 3:
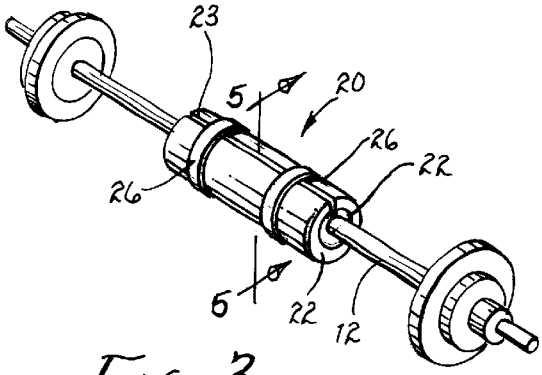
FIG. 3 is a perspective view of a barbell with the shoulder protection device of the present invention.
Figure 4:
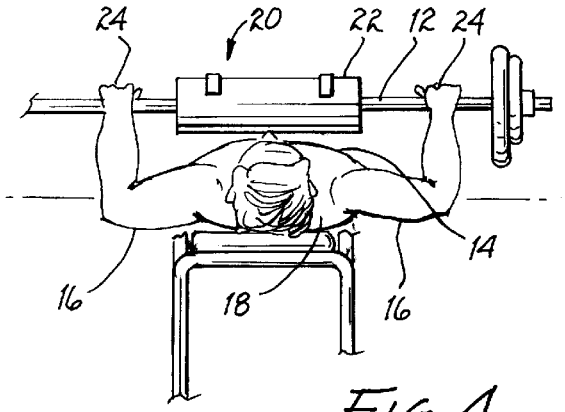
FIG. 4 is an end view of a person performing a bench-press-exercise with an ordinary barbell, with the shoulder protection device of the present invention, showing the preferred location of the upper arm when the barbell reaches its lowest point during the performance of the exercise.
Figure 5:
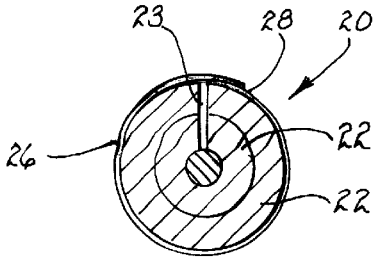
FIG. 5 is a cross-sectional view of the shoulder protection device of FIG. 3, mounted on a barbell, taken along lines 5—5.

Referring now to FIGS. 3–5, reference number 20 refers generally to the shoulder protection device of the present invention. Preferably, the shoulder protection device 20 consists of at least one pad 22, which pad 22 is preferably cylindrical in configuration, with an opening 23 for allowing the pad 22 to be fitted over the barbell 12. Furthermore, the pad 22 is preferably comprised of a deformable material, such as a foam rubber-type material, so as to be comfortable when contacting the chest 14 of a user during exercise. However, because a the ordinary barbell 12 is comprised of metal and is uncovered during typical use, non-deformable materials may also be used, with adjustments to be made to the opening 23 to accommodate the use of such non-deformable materials.

The pad 22 is preferably cylindrical in configuration, and preferably has a length that is at least substantially that of the width of a person's chest 14. In this manner, the preferred orientation of the barbell 12 during exercise—substantially parallel to the ground (not shown)—can be maintained. In this regard, a narrower pad 22 may cause a pivoting effect, disturbing the preferred parallel orientation of the barbell 12. On the other hand, the pad 22 should not be so long as to interfere with the person's 10 placement of his or her hands 24 on the barbell 12. However, while a cylindrical shape for the pad 12 is preferred, other shapes conferring at least substantially the same benefits may be possible.

Referring specifically to FIGS. 3 and 5, one manner of sizing of the shoulder protection device 20 is shown. It is possible to have more than one size of pad 22, with the person 12 selecting the particular pad 22 having the transverse thickness needed to allow the person 12 to perform a bench press exercise in the manner shown in FIG. 4. In this regard, a pad 22 having too great a transverse thickness would prevent the upper arms 16 from reaching the desired bottom-most in the horizontal plane defined by the back 18 (as shown in FIG. 4). Such an over-thick pad 22 would confer the shoulder protection benefits described herein, but could unnecessarily deny a portion of the pectoral muscle development benefits potentially realizable without undue risk to the shoulder muscles. On the other hand, an over-thin pad 22 would allow the upper arms 16 to break the horizontal plane defined by the back 18, albeit by less than would be possible without the presence of any pad 22. Such a configuration would provide some, though not all, of the preferred shoulder protection benefits.

As shown in FIGS. 3 and 5, sizing of the shoulder protection device 20 may also be accomplished by providing a plurality of pads 22 or progressively greater dimension (only two are shown here, but a number greater than two is possible), with a person 12 placing progressively larger pads 22 over one another until the desired transverse thickness is achieved.

It is necessary that the pad 22 be secured to the barbell 12 sufficiently so that is cannot become dislodged during use. Such securing can be accomplished, without the need for any structure other than the pad 22, by the use of material in the construction of the pad 22 having sufficient rigidity so that the barbell 12 is not able to accidentally move into the opening 23 during exercise, and so that undo lateral movement of the pad 22 during exercise is also prevented. (Indeed, while the pad 22 is shown having an opening 23 so as to make the pad 22 useable with an existing barbell 12, the pad 22 could be permanently affixed to a barbell 12, without an opening 23, so that use of the barbell 12 without the shoulder protection device 20 is not possible.) Securing can also be accomplished through the use of one or more straps 26, which are secured over the pad 22 and fastened with corresponding hook and loop fastening components 28 located at opposite ends of the straps 26.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method for reducing shoulder injury during the performance of a bench press exercise comprising the steps of:

providing a pad adapted to be coupled to a barbell substantially at a location where said barbell contacts a person's chest during a bench-press-type exercise;

wherein said pad is so dimensioned to project outwardly from said barbell sufficiently to prevent a person performing said bench-press-type exercise from lowering said person's upper arms below a horizontal plane defined by said person's back;

providing a securing member adapted to secure said pad to said barbell during said bench-press-type exercise; and performing a bench press type exercise by lowering said barbell with said pad thereon toward said chest.

2. The method of claim 1 wherein said pad is substantially cylindrical.

3. The method of claim 1 wherein said pad is deformable.

4. The method of claim 2 wherein said pad is deformable.

5. The method of claim 1 wherein said step of providing said securing member comprises the step of providing at least one strap dimensioned to encompass said pad in a direction that is substantially perpendicular to said barbell.

6. The method of claim 5 wherein said step of providing said at least one strap further comprises the step of providing a hook and loop coupling member.

7. The method of claim 1 further comprising the step of providing means for adjusting a thickness of said pad in the direction projecting outward from said barbell.

8. The method of claim 7 wherein said adjusting means comprises a second pad, adapted to be coupled over said pad.

* * * * *